US005414890A

United States Patent [19]

Morando

[11] Patent Number: 5,414,890

[45] Date of Patent: May 16, 1995

[54] MULTIPLE TOOTHBRUSH ARRAY

[76] Inventor: Rudolph J. Morando, 55 Prospect Rd., Andover, Mass. 01810

[21] Appl. No.: 192,551

[22] Filed: Feb. 7, 1994

[51] Int. Cl.[6] ..... A46B 9/04

[52] U.S. Cl. ..... 15/167.1; 15/145; 15/159.1; 206/362.1; 300/21

[58] Field of Search ..... 15/143.1, 145, 167.1, 15/159.1, 160, 176.1; 206/361, 362, 362.1, 362.2, 362.3, 820

[56] References Cited

U.S. PATENT DOCUMENTS

| | | | |
|---|---|---|---|
| 2,893,036 | 7/1959 | Filler | 15/188 |
| 3,070,102 | 12/1962 | MacDonald | 206/361 |
| 3,094,729 | 6/1963 | Dalton | 206/820 |
| 3,311,229 | 3/1967 | Troll | 206/820 |
| 3,951,460 | 4/1976 | Blankschein | 206/362.1 |
| 4,203,515 | 5/1980 | Kahn | 206/820 |
| 4,283,808 | 8/1981 | Beebe | 15/167.1 |
| 4,469,223 | 9/1984 | Smith | 206/362 |
| 4,821,359 | 4/1989 | Deziel | 15/159.1 |

FOREIGN PATENT DOCUMENTS

| | | | |
|---|---|---|---|
| 1124213 | 5/1982 | Canada | 15/145 |
| 2840429 | 3/1980 | Germany | 15/145 |

*Primary Examiner*—Timothy F. Simone
*Assistant Examiner*—Randall E. Chin
*Attorney, Agent, or Firm*—Cesari & McKenna

[57] ABSTRACT

An array of toothbrushes that may be individually withdrawn from a single, conveniently stored unit. The brushes may contain fewer and/or less durable bristles compared with commercially marketed items, or may instead be configured for use on patients having special dental needs. An optional extension feature permits the array to be manufactured with relatively small planar dimensions, thereby further reducing storage requirements, and also improves the convenience of use by providing a more comfortable grip.

8 Claims, 2 Drawing Sheets

FIG. 1B
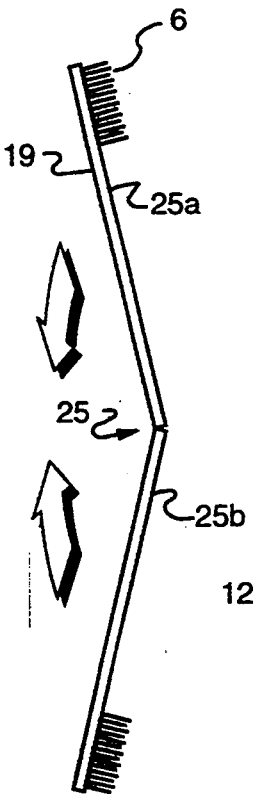
FIG. 1A
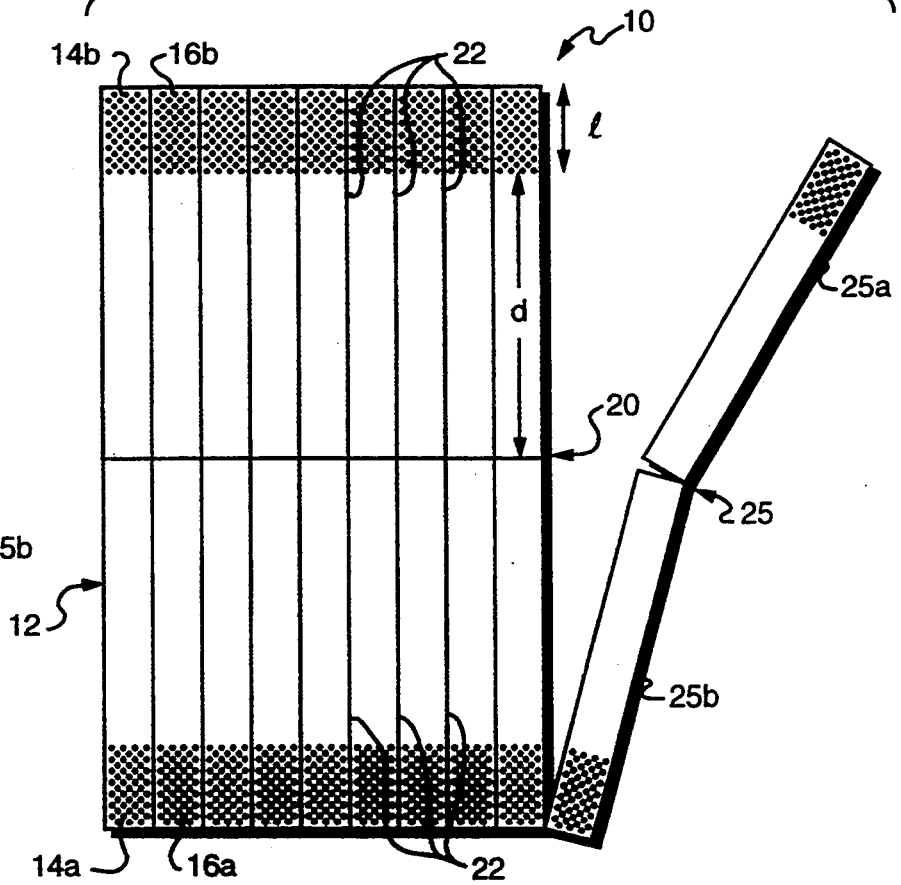
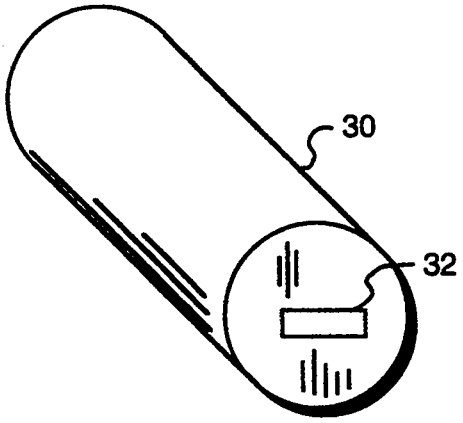
FIG. 2

MULTIPLE TOOTHBRUSH ARRAY

BACKGROUND OF THE INVENTION

1. Field of the Invention

The present invention relates to dental-hygeine products, and in particular to a multiple toothbrush package suitable for mass distribution and use.

2. Description of the Related Art

The traditional toothbrush consists of a generally elongated handle that terminates in an array of stiff bristles projecting at right angles to the handle. These bristles, usually made from a durable, flexible material such as nylon, are frequently rounded and tapered for user comfort and to encourage smooth brushing strokes.

Despite its mundane usage, the toothbrush has attracted substantial engineering attention in response to dental studies demonstrating persistent patterns of improper use and to accommodate particular dental conditions. For example, many toothbrushes now contain canted heads, wherein the portion of the handle bearing the bristles forms an angle with the remainder; this construction eases access to difficult-to-reach mandibular regions. Purchasers can choose among a range of bristle stiffness values, and the array of bristles may be tilted, beveled or otherwise shaped to increase cleaning efficacy.

Such advances have certainly reduced tooth decay among healthy consumer population, and reflect increased popular and medical attention to the benefits of dental hygeine. However, this very attention has also prompted recognition of the need to maintain the dental health of medically compromised patients—individuals for whom such care had once been considered extravagant. Thus, oncology patients now receive frequent dental examinations and tooth care, with the result that fewer such patients develop oral infections; and care providers regularly clean the teeth of convalescents and paralytics unable adequately to brush properly.

In a large institutional setting, such as a hospital, toothbrushes are frequently discarded after a single use. This practice avoids the spread of infection through inadvertent application of a single toothbrush to multiple patients, and reflects the impracticality of associating easily confused medical utensils with particular individuals. This practice is wasteful of toothbrushes that have been manufactured for extended use. Furthermore, since these toothbrushes are typically packaged individually, storage requirements for large patient populations can be considerable.

Cost and inconvenience may be increased further by the need to maintain toothbrushes having different constructions and bristle grades for different patient subsets.

DESCRIPTION OF THE INVENTION

Brief Summary of the Invention

The present invention provides an array of toothbrushes that may be individually withdrawn from a single, conveniently stored unit. The brushes may contain fewer and/or less durable bristles compared with commercially marketed items, or may instead be configured for use on patients having special dental needs. An optional extension feature permits the array to be manufactured with relatively small planar dimensions, thereby further reducing storage requirements, and also improves the convenience of use by providing a more comfortable grip.

BRIEF DESCRIPTION OF THE DRAWINGS

The foregoing discussion will be understood more readily from the following detailed description of the invention, when taken in conjunction with the accompanying drawings, in which:

FIG. 1A is a plan view of the preferred embodiment of the present invention, showing its mode of operation;

FIG. 1B is a side view of a detached element of the embodiment shown in FIG. 1A;

FIG. 2 is an isometric illustration of an optional extension receptacle;

DETAILED DESCRIPTION OF THE PREFERRED EMBODIMENTS

Figure 3:
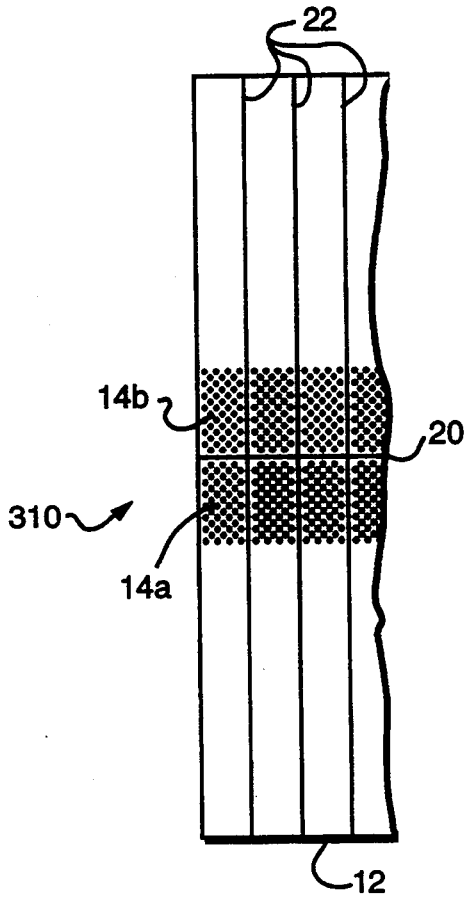
FIG. 3 is a plan view of an alternative embodiment of the invention, with brushes positioned along a medial score line.

Refer first to FIG. 1, which illustrates a disposable toothbrush array in accordance with the present invention. The array, denoted generally by reference numeral 10, comprises a generally planar, card-like support member 12 that bears a series of opposed brush pairs, each comprising a band of upstanding bristles. Two such brush pairs are representatively denoted at 14*a*, 14*b* and 16*a*, 16*b*. The bristles of each brush are arranged in a pattern and suited to a particular usage. For example, in embodiments destined for institutional settings where each brush will be used but a single time, the bristles may be distributed less densely than would be the case in a standard commercial brush. Alternatively, the bristles may instead be arranged to accommodate or for treatment of particular dental conditions, such as gingivitis or periodontitis, along lines well-known to those skilled in the art.

Extending across support member 12, at a position approximately equidistant between opposed brushes, is a medial score line 20. Transverse to medial score line 20 is a series of division score lines shown generally at 22, which also extend fully across support member 12 and separate opposed brush pairs. Score lines 20 and 22 extend deeply enough into the thickness of support member 12 to permit substantially even separation of oppositely disposed portions of the support member. To facilitate this action and for general durability considerations, support member 12 is preferably made of a flexible but strong material, such as plastic, that lends itself to tearing across a score line.

In operation, a user separates an endmost pair of opposed brushes from the remainder of support member 12 along the appropriate score line 22. The two brushes, now a detached element indicated by reference numeral 25, may then be separated from one another along score line 20, as shown in FIG. 1B, to provide two separate brushes 25*a*, 25*b*, each containing a brush head and a handle segment.

If the handle segment is of sufficient length, the brushes may be used immediately. However, for maximum storage a packaging convenience, it may be desirable to keep the overall dimension of support member 12, and therefore the distance between opposed brush heads in the illustrated embodiment, relatively small; for example, the handle distance d between medial score line 20 and the nearest edge of a brush may be kept to two to four times the length l of the brush. In such a case, a separated brush may be used in conjunction with an elongated extension receptacle 30, which admits and retains the handle segment within a complementary cavity 32. Receptacle 30 not only adds length to the handle segment of a brush, but may also be provided with a knurled surface and a sufficiently wide dimension to be easily gripped by a user during brushing.

Figure 4:
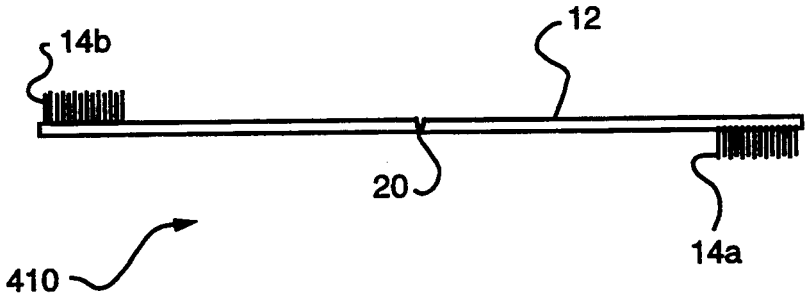
FIG. 4 is an elevational view of a third embodiment of the invention, with brushes positioned on opposite sides of a support member.

Alternative constructions within the scope of the invention are possible. For example, in a second embodiment, shown in FIG. 3 and denoted generally by reference numeral 310, opposed brush pairs are located on immediately opposite sides of medial score line 20, with the handle segment extending toward opposite edges. In third embodiment, shown at reference numeral 410 in FIG. 4, the opposed brushes also lie on opposite sides of support member 12. Thus, as used herein, the term "opposed" when applied to brushes includes all of these different arrangements.

Accordingly, it will be seen that I have invented a versatile packaging arrangement for toothbrushes, and that my design is capable of being implemented in a variety of ways. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A disposable toothbrush array comprising:

a. a card-like support member having four edges;

b. a tearable medial score line in the support member;

c. a plurality of tearable division score lines extending across the support member perpendicular to the medial score line;

d. the support member comprising a plurality of pairs of toothbrushes oppositely disposed with respect to one another across the medial score line and between the division score lines, each toothbrush comprising a band of upstanding bristles; and e. a handle portion associated with each toothbrush and formed from the support member by substantially even manual separation of portions of the support member oppositely disposed across the medial score line and substantially even manual separation of portions of the support member oppositely disposed across one of said division score lines.

2. The array of claim 1 wherein the medial score line is located midway between pairs of oppositely disposed toothbrushes.

3. The array of claim 1 further comprising an extension receptacle for receiving a separated toothbrush and handle portion.

4. The array of claim 1 wherein each toothbrush comprises a plurality of rounded and tapered plastic bristles.

5. The array of claim 1 wherein the handle portion has a length no greater than four times that of a portion of said toothbrush supporting said upstanding bristles.

6. A method of making a disposable toothbrush array, the method comprising the steps of:

a. forming a card-like support member having four edges wherein the support member comprises at least one pair of toothbrushes oppositely disposed to one another across the support member, each toothbrush comprising a band of upstanding bristles;

b. inscribing a medial score line in the support member between two edges thereof and separating the oppositely dispose toothbrushes, the medial score line having a depth sufficient to permit substantially even manual separation of portions of the support member oppositely disposed with respect thereto; and c. defining handle portions in the support member by inscribing at least one division score line across the support member perpendicular to the medial score line and between toothbrush pairs, the at least one division score line having a depth sufficient to permit substantially even manual separation of portions of the support member oppositely disposed with respect thereto, each handle portion being defined by the medial score line and at least one division score line.

7. The method of claim 6 further comprising the step of tearing the support member along the medial score line to separate oppositely disposed toothbrushes of the support member.

8. The method of claim 7 further comprising the step of tearing the support member along the division score line closest to one of the edges of the support member to separate one of said toothbrushes from the remainder of the support member.

* * * * *